United States Patent [19]

Rinehart

[11] 4,104,740

[45] Aug. 8, 1978

[54] MITTEN CONSTRUCTION

[75] Inventor: Dixie L. Rinehart, Aspen, Colo.

[73] Assignee: Comfort Products, Inc., Aspen, Colo.

[21] Appl. No.: 728,876

[22] Filed: Oct. 1, 1976

[51] Int. Cl.[2] ..... A41D 19/00

[52] U.S. Cl. ..... 2/158

[58] Field of Search ..... 2/158–161, 2/163, 164, 167, 169

[56] References Cited

U.S. PATENT DOCUMENTS

| | | | |
|---|---|---|---|
| 861,974 | 7/1907 | Hall | 2/158 |
| 1,478,582 | 12/1923 | Schallman | 2/164 |
| 1,796,319 | 3/1931 | Burden | 2/161 R |
| 2,603,790 | 7/1952 | Boehm-Myro | 2/158 |
| 2,735,108 | 2/1956 | Cremer | 2/164 X |
| 2,840,823 | 7/1958 | Kita | 2/161 R |
| 3,267,486 | 8/1966 | Madnick | 2/164 |
| 3,403,408 | 10/1968 | Helfer | 2/158 |
| 3,548,413 | 12/1970 | Jackson | 2/164 X |
| 3,997,922 | 12/1976 | Huhta | 2/161 A |
| 4,000,524 | 1/1977 | Rinehart | 2/161 R |

FOREIGN PATENT DOCUMENTS

| | | | |
|---|---|---|---|
| 2,287,864 | 5/1976 | France | 2/158 |

*Primary Examiner*—Werner H. Schroeder

*Attorney, Agent, or Firm*—Pennie & Edmonds

[57] ABSTRACT

A glove construction in the form of a mitten which will conform to the hand during flexing movement. The construction comprises an outer shell covering having back and palm portions joined together to form a mitten. An inner lining having individual finger receiving pockets is included within the shell and is bonded to the palm portion of the shell. The back portion of the shell has pleated joints extending across the width thereof.

1 Claim, 5 Drawing Figures

MITTEN CONSTRUCTION

REFERENCE TO OTHER APPLICATIONS

The glove construction includes features disclosed in my copending application Ser. No. 604,711, filed Aug. 14, 1975, now U.S. Pat. No. 4,000,524.

BACKGROUND OF THE INVENTION

Conventional mittens which are worn for warmth usually provide more protection against cold than a glove having individual fingers. Such mittens, however, lack the feel imparted by a fingered glove and will tend to "blouse". That is, the hand of the wearer may be clenched inside the mitten but the mitten will tend to remain in a straightened position making it difficult to hold items, as for example ski poles.

It is therefore an object of my invention to provide for a glove construction which will provide the warmth of the conventional mitten without the objectionable "blousing" feature and at the same time provide the feel and flexibility of a fingered glove.

Conventional mittens further have round or oval fingertip configurations which inhibit easy grasping of items such as ski poles. It is therefore a further object of my invention to provide a glove construction in the form of a mitten which has a square end for accommodating the natural fingertip profile when a hand is grasping an item.

GENERAL DESCRIPTION OF THE INVENTION

Broadly, my invention comprises forming a mitten with an outer shell covering where the shell covering has a back portion adapted to overlie the back of a hand and a palm portion adapted to overlie the palm of a hand. An inner lining is contained within the shell covering where the lining has individual finger receiving pockets.

In addition the back portion has a plurality of pleated joints extending across its width to provide telescopic sections between the joints such that the back portion may be easily flexed and unflexed during clenching and unclenching movement of the hand and with the result that the back portion will conform to the back of the hand and prevent "blousing."

Further the inner lining is preferably bonded to the inside palm portion of the shell covering which prevents that portion from blousing with respect to the palm of the hand of the wearer.

The lining portion preferably may comprise a pile material and the shell covering preferably comprises a treated leather material having moisture-resistant properties.

DESCRIPTION OF THE PREFERRED EMBODIMENTS

Figure 1:
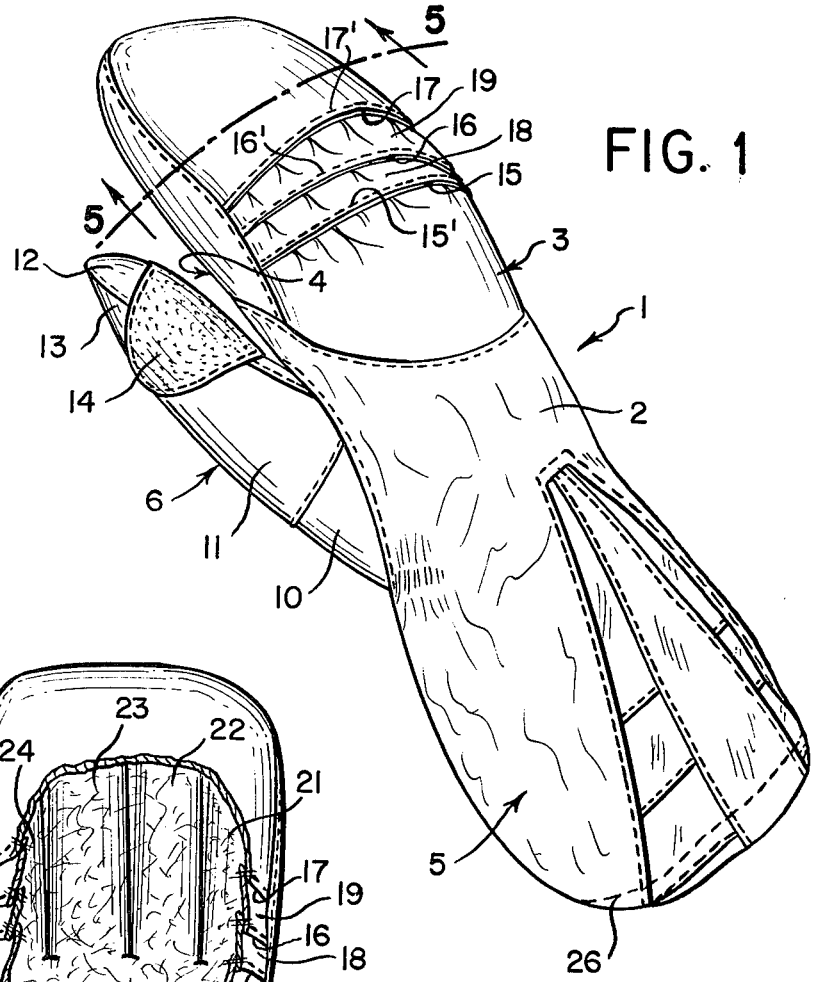
FIG. 1 is a perspective view of a glove construction according to the invention.

Referring to the drawings there is shown a glove construction 1 comprising a shell covering 2 having a back portion 3, a palm portion 4, a gauntlet portion 5 and a thumb portion 6. Preferably the shell covering is made from a leather material which is treated by spraying a heat sensitive acrylic urethane emulsion onto the inner surface of the leather which is then subjected to heat and pressure. As disclosed in my copending application Ser. No. 604,711 some of this emulsion will penetrate into the leather to form a thin film which in turn provides a moisture barrier. The outer surface of the shell covering remains untreated to preserve the natural appearance and feel of leather.

The thumb portion 6 of the glove construction comprises a metacarpal portion 10, a first phalanx portion 11, a second phalanx portion 12, a third phalanx portion 13 and an abrasive portion 14 cut and joined in the manner as shown in my copending application Ser. No. 604,711. This particular construction provides a thumb portion which will readily conform to movements of the thumb.

Figure 4:
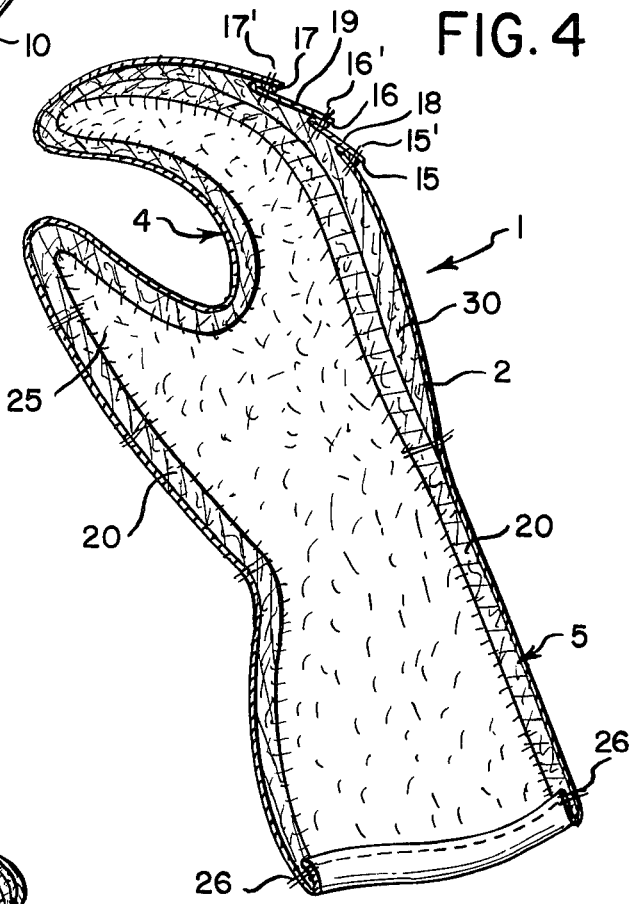
FIG. 4 is a cross-sectional view of the glove of FIG. 1.

The back portion 3 of the outer shell covering has a plurality of pleated joints 15, 16 and 17 extending across the width of the back portion where the joints are formed by folding the covering and stitching the folds by stitches 15', 16' and 17' as shown in FIGS. 1 and 4. The areas of the back portion between the pleats form telescopic sections 18 and 19 as shown in FIGS. 1 and 4 which may move relative to each other when the hand of the glove wearer is flexed which aids in the back portion conforming to the back of the hand.

The glove construction includes an inner lining 20 comprising a pile-like material which is in the form of a fingered glove having finger portions 21, 22, 23 and 24 to form finger receiving pockets. A thumb portion 25 is also included in the lining. The lining 20 is sewn to the open end of the gauntlet portion as illustrated by stitching 26 in FIG. 4. Preferably the lining is bonded to the inwardly facing side of the palm portion 4 of the shell covering in the area 27 to assure that the palm portion of the shell covering will conform to movement of the hand and prevent "blousing." The back side of the finger portions of the lining may also be bonded to the inwardly facing side of the back portion 3 of the shell to provide still further assurance against "blousing."

Preferably the pile material has hydrophobic properties which reduce moisture accumulation in the glove structure where the accumulation could result in discomfort and decrease in thermal protection of the glove.

Figure 5:
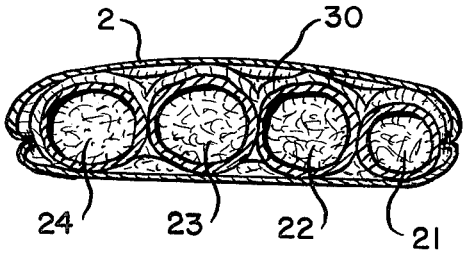
FIG. 5 is a cross-sectional view of the glove construction of FIG. 1 taken along line 5—5.

As shown in FIGS. 4 and 5, an extra layer 30 of lining material may be applied to the back part of the inner lining over and around the ends of the finger portions as well as over the part of the inner lining adapted to overlie the back of the hand since it is the back portion of the hand and back portion of the fingers as well as the fingertips that are most sensitive to cold.

Figure 2:
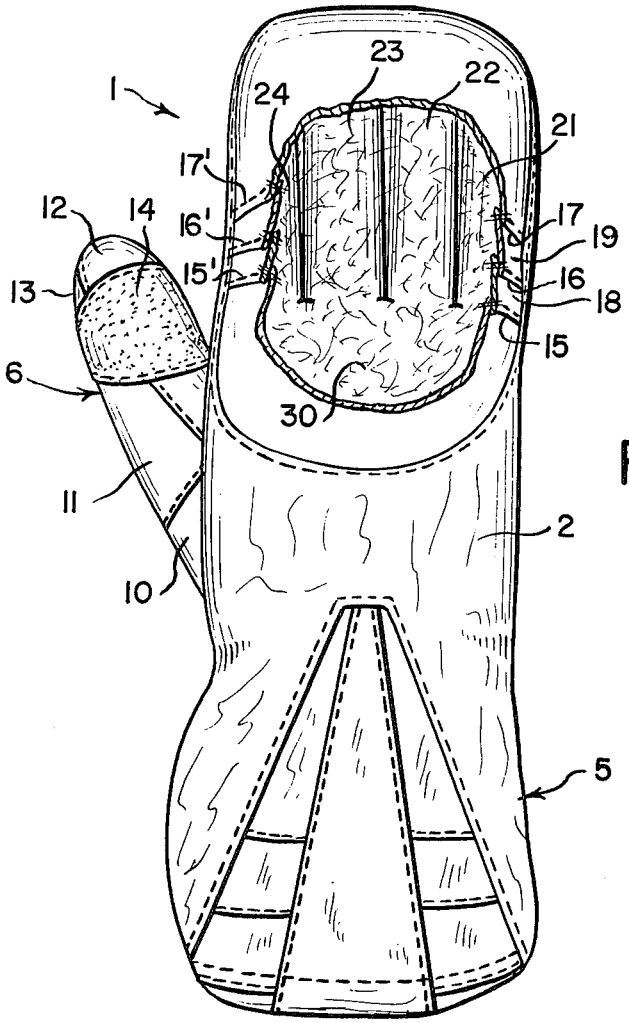
FIG. 2 is a plan view of the glove construction of FIG. 1 with a top portion of the shell covering broken away.
Figure 3:
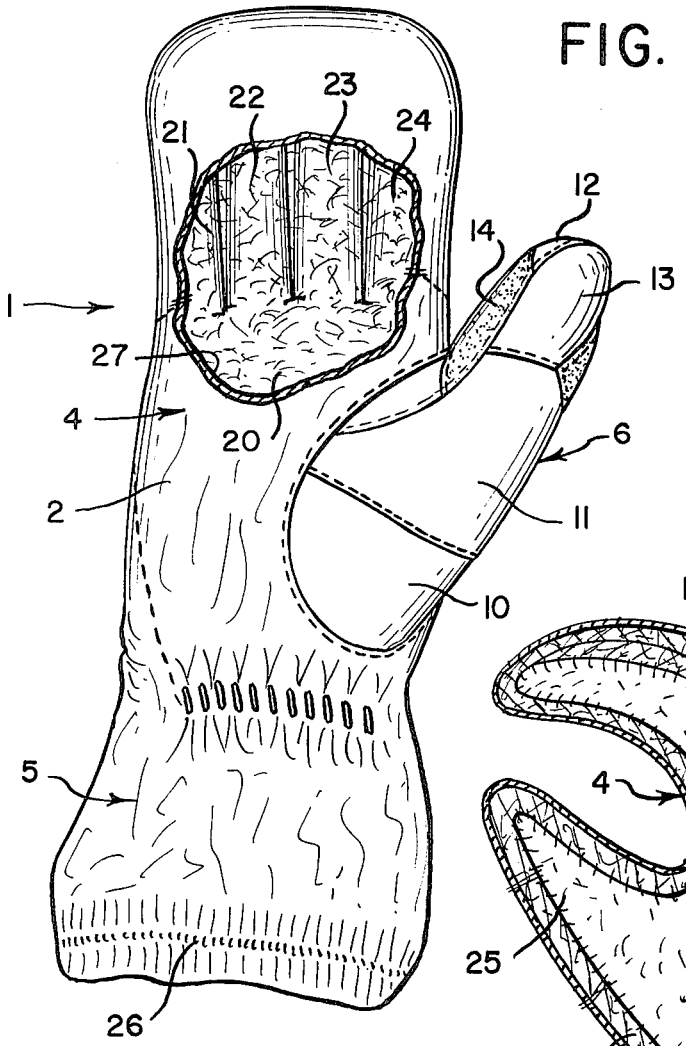
FIG. 3 is a bottom view of the glove construction of FIG. 1 with a portion of the shell covering broken away.

As shown in FIGS. 1 and 2, the shell covering 2 has a square end and the finger portions of the inner lining forming the finger receiving pockets extend to the end of the shell covering. This facilitates grasping of an object such as a ski pole since the fingertips when in the grasping position tend to be in line.

I claim:

1. A glove constructed in the form of a mitten which comprises in combination:

(A) a shell covering having a back portion, a palm portion, a gauntlet portion and a thumb portion;

(B) said back portion having a plurality of pleated joints extending across the width of the back portion;

(C) said pleated joints being formed by folding the covering and stitching the folds across the back portion in the area of finger bends of a glove wearer;

(D) an inner lining of pile-like material fixedly secured to an inner surface of said shell and configured in the form of a fingered glove having finger portions defining finger receiving pockets extending forwardly to a seam connecting the back portion and the palm portion, and (E) said outer shell having a square front end construction at said seam.

* * * * *